United States Patent [19]

Callahan

[11] Patent Number: 4,600,976

[45] Date of Patent: Jul. 15, 1986

[54] COLOR CHANGER MECHANISM

[76] Inventor: Michael Callahan, 201 W. 85th St., New York, N.Y. 10024

[21] Appl. No.: 704,750

[22] Filed: Feb. 25, 1985

[51] Int. Cl.[4] ..... F21V 9/00

[52] U.S. Cl. ..... 362/277; 362/283; 362/293

[58] Field of Search ..... 362/277, 16, 17, 18, 362/256, 268, 269, 271, 293, 311, 324, 255, 257, 282, 283, 284, 351; 353/84

[56] References Cited

U.S. PATENT DOCUMENTS

| | | | |
|---|---|---|---|
| 726,199 | 4/1903 | Spangenberg . | |
| 761,066 | 5/1904 | Engelsmann . | |
| 819,611 | 5/1906 | Sohlberg . | |
| 1,045,063 | 11/1912 | Naujoks . | |
| 1,460,644 | 7/1923 | Dollison et al. | 362/293 |
| 1,654,873 | 1/1928 | Greenewalt . | |
| 1,679,361 | 8/1928 | Kliegl . | |
| 1,740,463 | 12/1929 | Kliegl . | |
| 1,740,603 | 12/1929 | Kellert . | |
| 1,766,637 | 6/1930 | Hopewell . | |
| 1,818,718 | 8/1931 | Kliegl | 362/293 |
| 1,820,899 | 8/1931 | Greenewalt . | |
| 1,875,814 | 9/1932 | Kliegl . | |
| 2,129,641 | 9/1938 | Baughman et al. | 362/284 |
| 2,133,608 | 10/1938 | Engelken . | |
| 2,192,520 | 3/1940 | Levy et al. . | |
| 2,214,728 | 9/1940 | Gille et al. . | |
| 2,950,382 | 8/1960 | Hatch | 362/294 |
| 3,818,216 | 6/1974 | Larrabury | 362/293 |
| 3,845,351 | 10/1974 | Ballmoos et al. | 315/293 |
| 3,900,726 | 8/1975 | Tichenor | 362/277 |
| 4,037,097 | 7/1977 | Stillman et al. . | |
| 4,298,920 | 11/1981 | Gluck et al. | 362/293 |

FOREIGN PATENT DOCUMENTS

| | | | |
|---|---|---|---|
| 2075720 | 11/1981 | United Kingdom | 362/277 |

*Primary Examiner*—Charles J. Myhre
*Assistant Examiner*—David A. Okonsky
*Attorney, Agent, or Firm*—Kenyon & Kenyon

[57] ABSTRACT

An improved color changer apparatus for use with lighting fixtures suitable for performance lighting is disclosed. Each of a plurality of parallel-spaced planar filters are adapted to be moved in and out of the fixture beam by rotation in a plane perpendicular to the beam about an effective pivot point. Each such filter is capable of continuous rotation about its effective pivot point and the filters are so shaped that the leading edge of one filter and the trailing edge of another can be aligned such that no ray of light in the beam can pass through either both filters or neither one.

9 Claims, 4 Drawing Figures

COLOR CHANGER MECHANISM

This application relates to entertainment lighting and, more specifically, to an improved design for a color changer and arises out of inventive disclosures filed as: Disclosure Document No. 115,260, dated Feb. 25, 1983, and application Ser. No. 443,127, filed Nov. 19, 1982, and now U.S. Pat. No. 4,527,198.

BACKGROUND OF THE INVENTION

In virtually every application in which lighting fixtures are used to produce an aesthetic effect, most notably in entertainment and display lighting, a means of selectively varying the apparent color of the light beam is required.

For this purpose, virtually every lighting fixture produced for entertainment and display applications provides some means to support a planar filter material in its beam. Beam color is changed by changing the filter material.

This filter material or "gel" generally consists of a flexible gelatin, cellulose acetate, mylar, or polyester base with a colored pigment disposed through the base or applied to it. Five major lines of flexible filter material are available, providing the lighting designer with a choice of more than 200 distinct colors. More recently, interference-type filters have been employed as well.

While the cost of the filter material itself is modest, the requirement that a change in beam color requires changing filter material has always had disadvantages in those applications which require that the color of the beam illuminating a given subject change during a performance.

One such application is the followspot. Followspots are light projectors designed for changes in beam azimuth, elevation, size, intensity, and generally shape and color, through the agency of a full time operator, traditionally located next to the fixture and actuating its beam modifying mechanisms directly by means of control levers projecting through the housing. A description of the Supertrouper followspot, for many years the standard of the industry, may be found in U.S. Pat. No. 2,950,382. In order to change beam color during the performance, virtually all followspots are provided with a mechanical color changer mechanism allowing the operator to insert any one or combination of six filters into the beam.

The applications for a mechanical method of changing filters and as such beam color during a performance are not restricted to the followspot. Without a method of changing beam color during a performance, lighting a given area of the stage in five colors during a performance generally requires the use of five fixtures, each provided with a different filter material but otherwise identical—at a very substantial increase in direct and indirect cost in fixtures, cabling, dimming, support, and control equipment, as well as the manpower required to install, adjust, and service this equipment.

It has long been apparent that if a fixture's color could be changed by remote control during the performance, that the number of fixtures required and as such the direct and indirect costs of the total lighting system could be dramatically reduced. As a result, methods of changing the color of a light source from a remote location found use with candles in the 1770s; with electric lights in the 1880s; and electrically actuated changers similar to those disclosed in U.S. Pat. Nos. 2,129,641 and 2,192,520 were in significant use in American theater by the 1930s.

The ultimate extension of the theory that a fixture with variable beam characteristics can produce a significant reduction in the size of the lighting system required to achieve a given series of effects leads us to a fixture, as disclosed in U.S. Pat. No. 3,845,351, whose every variable is adjustable under computer control, and a practical color changer is essential to its success.

And yet, despite the considerable attention paid to the design of color changers over the last half-century, no color changer mechanism yet disclosed in the art is capable of changing beam color without undesirable effects during the transition, effects whose aesthetic disadvantages represent a major impediment to the widespread adoption of such changers.

It is an object of the present invention to provide an improved color changer mechanism capable of changing beam color without undesirable intermediate effects.

SUMMARY OF THE INVENTION

The present invention provides an improved color changer mechanism which achieves these and additional objects through a number of unique features.

The color changer of the present invention employs a plurality of planar filters, generally consisting of a flexible filter material supported by a rigid frame. Like prior art "semaphore" changers, all such filter frames are adapted to rotate about an effective pivot point in a plane substantially perpendicular to the axis of the light beam in order to move the filter material in and out of the beam.

Unlike prior art color changers, the color changer of the present invention is adapted such that the filter frames are capable of continuous rotation about their effective pivot points. The frames are shaped and a means provided to synchronize their rotation such that the leading edge of a frame being inserted into the beam can be maintained in a substantially parallel relationship with the trailing edge of a frame being removed from the beam. As a result, a color-to-color transition is continuous and as substantially no ray of light in the beam can pass through either both filters or neither one, none of the undesirable intermediate effects typical of prior art color changers is produced.

A simple control system is also disclosed whereby the operation of the color changer may be controlled by either manual selection or from data stored in memory.

A means is also disclosed whereby the apparent saturation of the filter color may be varied by adjusting the relative proportion of the beam passing through the filter.

DETAILED DESCRIPTION

Figure 1:
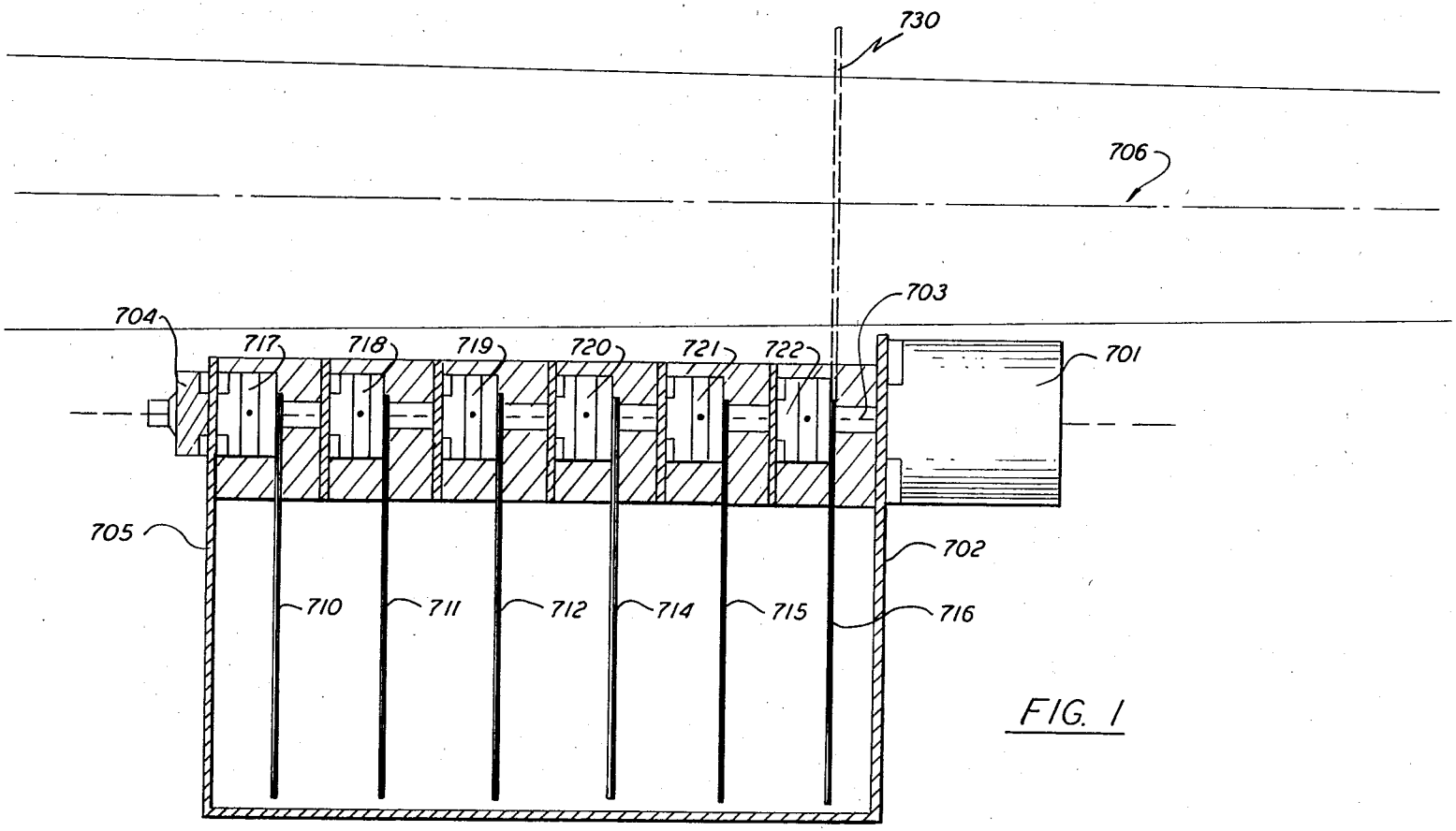
FIG. 1 is a side elevation of one embodiment of the color changer of the present invention.

Although two general classes of "color changer" have long been used with performance lighting equipment, none is capable of changing filters without an undesirable effect during the transition.

"Color wheels" use a disc with a number of circular openings for filter material spaced at a common radii about the center hub, the disc or "wheel" mounted with the beam passing through the openings and rotated to change beam color.

The color wheel's advantages include a high degree of reliability due to the mechanical simplicity of the device and the ability to remote its operation inexpensively with a single rotary actuator.

The color wheel's benefits are offset by several intrinsic drawbacks. The number of colors produceable is limited to the number of openings/filters as no subtractive combination of two filters is possible. Changing the color/filter also frequently requires passing through other, unwanted filters/colors occupying intermediate positions on the wheel. Further, if the fixture requires "white" or "no color" light, the white flash that results when cycling through the "clear" opening is even more objectionable. Recently, "roller" color changers which attach the filter to each other to form a strip scrolled back and forth between a supply and a takeup reel have also been employed, but these "linear filter wheels" suffer from the same disadvantages.

As a result of these disadvantages, all modern followspots employ "semaphore" changers—manually operated versions of the device disclosed in U.S. Pat. No. 2,129,641, while many remote color changers for other fixture types employ similar units equipped with actuators.

Unlike color wheels, semaphore changers allow changing between any two filters without passing through intermediate filters, allow subtractive combinations of more than one filter, as well as "white" light without sacrificing a filter position. But because the filters employed by all prior art changers enter and exit the beam from the same direction, it is necessary for the new color/filter to be fully inserted in the beam before the old one is removed if undesirable flashes of white light are to be avoided. However, this three-state process produces undesirable side effects (such as a third, subtractive color and/or a considerable decrease in beam intensity) for the period that both filters are in the beam. These effects, although not as noticeable with instantaneous color changes, are very much a problem when slow color-to-color fades are desired.

Semaphore changers as traditionally employed in prior art fixtures also require one actuator per filter frame to the color wheel's single actuator, making them considerably more expensive to remote.

It should be noted that while most such "semaphore" changers attach their color filters to a lever arm fixed to a pivot and move the filters in and out of the beam by rotating the filter about the pivot, that a few such changers have been built with filter frames retained between parallel rails and displaced in a straight line in order to bring them in and out of effective position with respect to the beam.

Refer now to FIGS. 1–4 where a new and novel color changer is illustrated combining much of the simplicity and reliability of the color wheel with the variety of effects possible with the semaphore changer and further allowing color-to-color transitions at any speed without undesirable intermediate combinations or effects of any kind.

The benefits of this new color changer are a product of its basic principles and a variety of manual and electrically actuated designs are possible. FIGS. 1–4 illustrates a version of intermediate mechanical and electrical complexity.

Refer now to FIG. 1, a side elevation of one embodiment of the color changer of the present invention, provided with a single rotary actuator 701. This actuator 701 is mounted to an end bracket 702 and its shaft 703 extends through the unit to a pillow block 704 mounted to a second end bracket 705.

The changer illustrated being a six filter unit, six filter frames 710–716 are provided. Each such filter frame is mounted to the armature of an electromagnetic clutch 717–722 (such as manufactured by The Electroid Company, 95 Progress Street, Union, N.J. 07083) whose rotor is attached to motor shaft 703.

Figure 2:
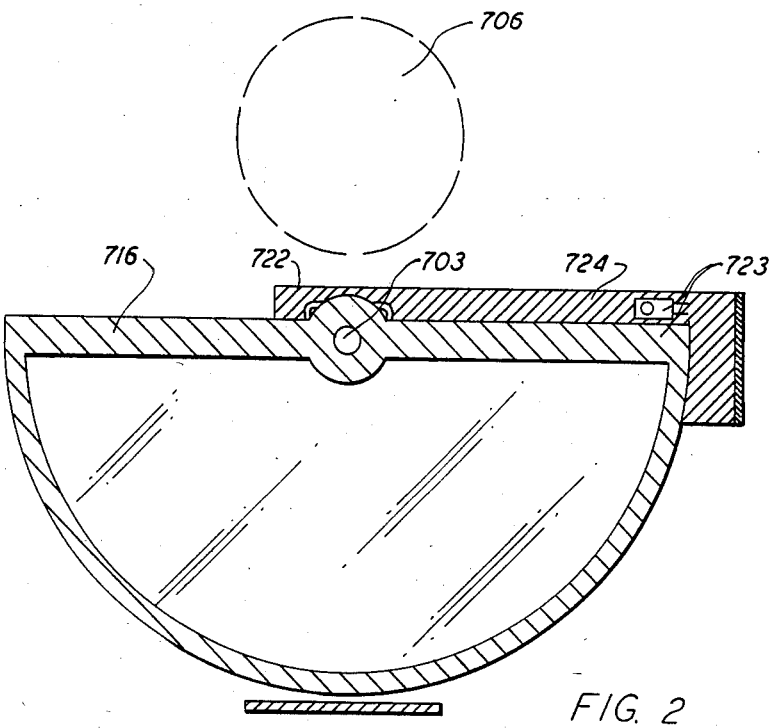
FIG. 2 is a sectional view of the color changer of FIG. 2 showing the filter frame in its storage position.
Figure 3:
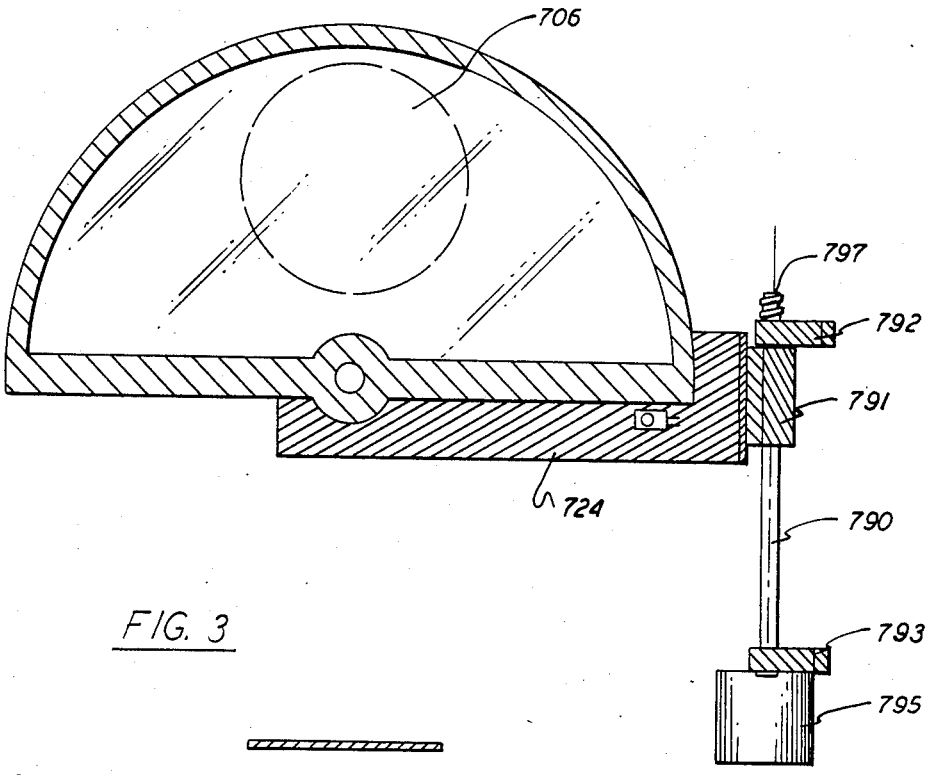
FIG. 3 is a sectional view of the color changer of FIG. 2 showing the filter frame in its active position.

Refer now to FIG. 2 and FIG. 3, sections through the unit providing a front elevation of a typical filter frame in its two operating positions. Each filter frame consists of two portions; one holding the filter material, and the other clear. The frame itself may include both the filter material and the open portions or may be limited to the filter material alone as illustrated in the figures.

Each frame/clutch combination is provided with a bracket 724 to prevent the clutch housing 722 from rotating and further mounting a sensing device 723 (here a pair of Hall Effect sensors as manufactured by Micro Switch Corporation, Freeport, Ill. 61032) sensing the filter portion of the frame.

The changer unit is mounted such that light beam 706 passes through the center of the filter area/radius. It will be understood that the location of the changer mechanism in the optical system of a given fixture is a matter of design choice. Where the changer is employed with a fixture imaging an aperture such as in the followspot of the referenced application the changer will preferably be installed internally (illustrated as 109 of FIG. 1B) as close to the aperture as possible in order to minimize the size of the filters. Alternatively, the changer may be mounted externally, particularly when designed as a retrofit to existing fixtures or when employed with fixture types which offer no such reduction in beam size.

Under white light or "no color" conditions, all six frames are rotated about shaft 703 to the position illustrated in both FIG. 1 and FIG. 2, with the filter portion opposite light beam 706. To color the beam, the electromagnetic clutch for the desired filter frame (in this example, frame 716 and clutch 722) is energized, coupling the frame to actuator shaft 703. Actuator 701 then rotates the filter frame 180°, inserting it into the beam, as illustrated in FIG. 3 (and in FIG. 1 as 730). The speed of actuator 701 determines the speed of the color change effect.

To change to another color/filter frame (e.g. filter 715), the electromagnetic clutches for both the frame currently in the beam (e.g. 716) and for the new frame (e.g. 715) are energized and the actuator 701 rotated through another 180°, returning the old frame 716 to the storage position illustrated in FIG. 2 and inserting the new filter frame 715 into beam 706 as illustrated in FIG. 3. Because the two filter frames are locked to shaft 703 in a relationship 180° apart with the leading edge of the new frame and the trailing edge of the old frame slightly overlapping, a continuous fade from one color to the next results. And because no ray of light in beam 706 can pass through either both filters or neither one, undesirable subtractive combinations and flashes of white are both avoided.

This ability of the color changer of the present invention to achieve direct color-to-color crossfades without the undesirable intermediate effects typical of prior art units does not preclude deliberate subtractive combinations for effect. A second color frame can be added to one already in the beam by energizing only its clutch; or two new frames replace one already in the beam by energizing the clutches for all three. The three-step subtractive combination transitions typical of semaphore changers can be simulated by simply energizing just the clutch for the new frame, rotating it into the beam, then energizing the clutch for the old frame and rotating it out.

Figure 4:
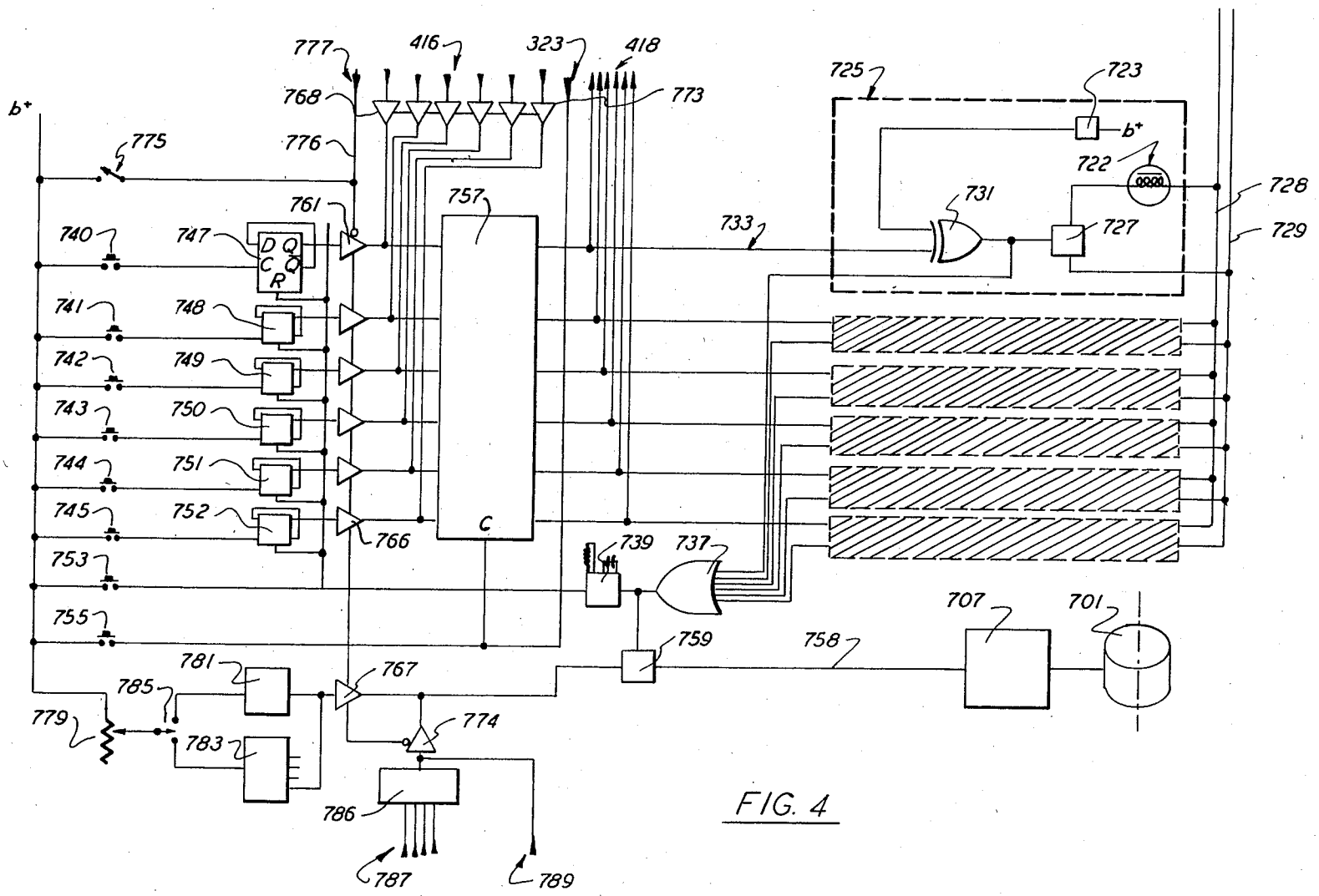
FIG. 4 is a block diagram of one embodiment of a control system adapted to the color changer of FIG. 2.

Refer now to FIG. 4 where a simple control system for the embodiment of the color changer of the present invention illustrated in FIGS. 1–3 is illustrated. Assembly 725 is typical of that required for each of the six filter frames 710–716.

Electromagnetic clutch 722's coil is connected to a power switching device 727, typically a triac, in turn connected with power supply busses 728 and 729. The gate of triac 727 is, in turn, connected with the output of an Exclusive OR gate 731, whose inputs are the frame sensing device 723 (which goes high when the frame reaches inserted position as illustrated in FIG. 3 and low when it reaches the storage position as illustrated in FIG. 2). The second input of OR gate 731 is line 733 which goes high when filter insertion is desired. The output of gate 731 is further connected with the input of six-input OR gate 737, whose other inputs are similarly connected with the outputs of the Exclusive OR gates of other assemblies.

Therefore, with the frame in the storage position illustrated in FIG. 2, the input from sensor 723 will be low. If the frame is not desired then both inputs to gate 731 will be low, as will its output. The coil of clutch 722 will thus remain deenergized and the frame remain in the storage position regardless of the rotation of shaft 703.

When, however, the input from line 733 goes high, indicating that the frame's insertion is desired, the output of gate 731 will go high, the clutch energize, and actuator 701 will be able to insert the gelled portion of the frame into beam 706.

Once the frame has reached the fully-inserted position illustrated in FIG. 3, the output of sensing device 723 will go high, causing the output of gate 731 to go low, deenergizing clutch 722, and therefore keeping the frame inserted in the beam regardless of further rotation of actuator shaft 703.

When control line 733 goes low again, indicating that the filter is no longer required, the output of gate 731 will go high again, causing clutch 722 to be energized so that actuator 701 can rotate the frame back to storage position. On reaching storage position, sensor 723 will go low, causing gate 731 to deenergize the clutch, keeping the frame in storage position regardless of further actuator shaft rotation.

Electrically-actuated versions of the color changer of the present invention may be controlled by manual selection and/or memory playback. FIG. 4 illustrates a simple control system capable of both.

The operator may manually preselect the desired frame or frames using momentary switches 740–745 which cause their associated D-type flip-flops 747–752 to latch the desired selection. "No color" operation or clearing an erroneous entry may be accomplished with the "Clear" button 753 which resets the presetting flip-flops 747–752.

On pressing the "Execute" button 755 or on receipt of a "Go To" instruction via line 323, register 757 loads the desired selection, making it visible to the Exclusive OR gates of the color changer which conform the frames to the desired condition in the manner previously described.

The control system illustrated is additionally capable of accepting color selection from a memory means. Lines 416 connect the memory system and the inputs of register 757 such that data present on lines 416 when the "Execute" button 455 is pressed or an external command is received via input 323 will be loaded into the register 757, making it visible to the Exclusive OR gates of the changer assemblies which conform the frames to the desired selection. To prevent register 757 from loading the "ORed" combination of both the manual selection from presetting flip-flops 747–752 and the memory selection via lines 416, tristate drivers 768–773 are inserted in the memory input lines to the register and tristate drivers 761–766 (whose control lines are inverted relative to those of 768–773) are inserted in the manual input lines to the register. Therefore buss 776 allows selecting either manual or memory input by means of a hardware switch such as 775 or under the direct control of the external device via input 777.

A variety of methods of entering color selection data into an associated or external memory device are possible. Lines 418 connect the output of register 757 with the memory device, allowing the storage of current color selection. Clearly, the memory device could also be connected to the outputs of preset flip-flops 747–752, allowing "blind recording" of selections. Selections could also be entered through additional input devices associated directly with the memory unit. The design of such memory devices is well understood by those skilled in the art and described in the referenced application.

Electrically actuated versions of the color changer of the present invention may employ a constant speed motor for actuator 701. However, the substitution of a variable-speed actuator allows control of color change speed. Accordingly FIG. 4 illustrates a stepper motor for actuator 701 with an associated drive 707.

The input device used to determine motor speed may take many forms—four are illustrated here:

The input device may perform the function of an analog rate control such as potentiometer 779 and a simple pulse generator 781 such as a monostable multivibrator be provided.

The input device may be a positioning control such as potentiometer 779, alternatively connected by mode switch 785 to A/D convertor 783, which is used to produce a pulse count proportional to input device movement and thus allow direct manual control over the progress of the color change.

Pulse rate information may be entered as a digital value (notably from a memory device) via input 787 to a digitally controlled pulse generator 786. Similarly, an externally generated analog value corresponding to a desired rate may be used as an input to pulse generator 781.

Further, an externally generated pulse train may be fed directly to the motor drive 707 via input 789. This method is particularly useful as a method of synchronizing simultaneous color changes by multiple fixtures.

The inputs from the manually selected rate control 779 and the externally-generated rate inputs 787 and 789 are also provided with tristate drivers 767 and 774 as a means of selecting either manual or memory operation by means of buss 776 as previously described.

Actuator 701 of the embodiment illustrated in FIGS. 1–4 may rotate continuously, only the electromagnetic clutches 717–722 responsive to the control system. However, FIG. 4 also illustrates a simple method of preventing unnecessary actuator rotation.

Motor control line 758 is provided with a switching device 759 whose control input is connected with the output of six-input OR gate 737.

On initiating a color change either by pressing the "Execute" button 755 or on receipt of an external "Go" command via input 323, register 757 loads the desired selection, making it visible to the Exclusive OR gates associated with each frame. The Exclusive OR gate of any frame not in the desired condition will go high, driving not just the switching device associated with its electromagnetic clutch, but causing the output of six-input OR gate 737 to go high as well, closing switching device 759 on motor control line 758 in turn causing motor 701 to rotate.

As each filter frame arrives at its desired condition, the output of its Exclusive OR gate will go low. When the last frame has arrived at the desired condition, and its Exclusive OR gate goes low, six input OR gate 737 goes low as well, opening switching device 759 on motor control line 758 causing motor 701 to stop.

Additionally, by providing a one-shot 739 producing a pulse on the negative-going edge of the output of 6-input gate 737, that pulse used to reset the preset flip-flops 747–752, the completion of the color change can be signalled to the operator and the selector switches 740–745 "cleared" for the next selection.

The control system of FIG. 4 thus, despite its simplicity, provides a complete set of feedback loops both within the frame and between frames and actuator.

The specific embodiment of the color changer of the present invention illustrated in FIGS. 1–4 should not be taken as limiting the generality of the claims in any way. Other versions may be designed with direct manual actuation of the frames and with mechanical means to assure the synchronization of frames. Similarly, a separate actuator may be provided for each frame, simply by substituting the actuator for the electromagnetic clutches illustrated in the figures. The control system of FIG. 4 may be adapted to such use simply by providing the output of motor drive 707 to busses 728 and 729 and by connecting the coils of the frame motors at the same location as clutch coil 722. It will be recognized that although separate actuators are employed for each frame, that synchronization can be maintained by the control system. It will also be recognized that the control system may employ a microprocessor.

Similarly, the frames themselves may consume more or less than 180° and the shape of their edges varied so long as the operating principle remains the same. In lieu of a central pivot, the frames may employ a continuous rim and be supported only at their edges. Similarly, the frames rather than being center-driven may be edge driven, and the frames fabricated with toothed edges to allow gear-driving.

The usefulness of the color changer of the present invention may also be extended by allowing the adjustment of color saturation by adjusting the relative proportion of the light beam passing through the filter frame. It will be understood that this effect can be produced by modifying the control system such that the rotation of the incoming filter is limited so as to be only partially inserted into the beam. However, at the next color change, the filter will be required to continue its rotation and thus would achieve full saturation before the new filter entered, producing an undesirable intermediate effect during the transition. This effect can be eliminated by modifying the control system such that direction of actuator rotation is reversed and the edges of the frames synchronized. The new frame would thus enter the beam from the side opposite the old one, and the outgoing frame synchronize with the new one when their edges overlapped, producing a color change with no undesirable effects. A less complex method of adjusting saturation is simply to displace the filter frame out of the beam. Accordingly, FIG. 3 illustrates the color changer supported on linear bearing 791 riding on rail 790 perpendicular to the axis of beam 706 and displaced by lead screw 797 and its associated actuator 795. Alternately, a system of prisms or mirrors could be used to divert the beam around the color changer.

What is claimed is:

1. An improved color changer suitable for use with a light projector generating a beam, said beam having an elongated axis and suitable for performance lighting; said color changer comprising a plurality of parallel axially-spaced color filters, each supported for independent and continuous rotation about an effective pivot point between a position in said beam and out of said beam, the leading edge of each of said filters having an opposite and complementary shape to the trailing edge of each of said filters, means for rotating said filters, and means for maintaining the trailing edge of one filter in alignment with the leading edge of another filter during rotation of said means for rotating so that at least two of said plurality of filters are continuously rotated together in one direction to move one filter out and the other filter into said beam in such a manner that substantially no ray of light in said beam may pass through either both filters or neither.

2. The apparatus according to claim 1, wherein said leading and said trailing edges each comprise a radius extending from the effective pivot point of said filter means.

3. Apparatus according to claim 1, and further including means for storing a plurality of values corresponding to desired color filter selections; means for entering said values into said means for storing; means for selecting the stored value corresponding to a desired selection to which the condition of said color changer is to be conformed; and means responsive to said means for selecting to provide an output to said means for rotating to cause the color filter corresponding to the selected value to be rotated into said beam.

4. Apparatus according to claim 3 and further incluidng means to store a further value corresponding to the desired speed of said actuator means for each of a plurilty of said values.

5. The apparatus according to claim 1, wherein said means for rotating comprises at least one electrically operated actuator.

6. The apparatus according to claim 5, wherein said means for rotating comprises one electrically operated actuator per filter and said means for maintaining alignment selectively energizes a plurality of said actuators in synchronism.

7. Apparatus according to claim 5, and further including means to vary the speed of said actuator.

8. The apparatus according to claim 5, wherein said means for rotating comprises a single electrically operated actuator and means for selectively coupling one and the other of said filters to said actuator.

9. Apparatus according to claim 8, wherein said means for maintaining alignment selectively operates said means for selectively coupling in synchronism.

* * * * *